United States Patent [19]

Lyons, Jr. et al.

[11] Patent Number: 4,585,061

[45] Date of Patent: Apr. 29, 1986

[54] APPARATUS FOR INSERTING AND WITHDRAWING COILED TUBING WITH RESPECT TO A WELL

[75] Inventors: Robert A. Lyons, Jr., Carrollton; Johnnie B. Maschek, Jr., Fort Worth, both of Tex.

[73] Assignee: Hydra-Rig Incorporated, Fort Worth, Tex.

[21] Appl. No.: 543,091

[22] Filed: Oct. 18, 1983

[51] Int. Cl.[4] ..... E21B 19/00

[52] U.S. Cl. ..... 166/77; 166/85; 226/172; 254/29 R

[58] Field of Search ..... 166/77, 77.5, 85, 384, 166/385; 175/162, 202, 203, 220, 122, 103; 226/189, 190, 192, 194, 172, 173; 254/29 R; 72/160, 161

[56] References Cited

U.S. PATENT DOCUMENTS

| | | | |
|---|---|---|---|
| 2,567,009 | 9/1951 | Calhoun et al. | 166/1 |
| 2,681,793 | 6/1954 | Miller | 308/187 |
| 3,182,877 | 5/1965 | Slator et al. | 226/172 |
| 3,285,485 | 11/1966 | Slator | 226/172 |
| 3,373,818 | 3/1968 | Rike et al. | 166/77 |
| 3,401,749 | 9/1968 | Daniel | 166/384 |
| 3,618,840 | 11/1971 | Courret | 226/172 |
| 3,667,554 | 6/1972 | Smitherman | 175/57 |
| 3,690,136 | 9/1972 | Slator et al. | 72/160 |
| 3,724,567 | 4/1973 | Smitherman | 166/77 |
| 3,822,559 | 7/1974 | Matthews, Jr. et al. | 72/161 |
| 3,827,487 | 8/1974 | Jackson et al. | 166/77 |
| 3,866,882 | 2/1975 | Willm et al. | 254/29 |
| 3,920,076 | 11/1975 | Laky | 166/77 |

FOREIGN PATENT DOCUMENTS

| | | | |
|---|---|---|---|
| 953644 | 8/1974 | Canada | 166/521 |
| 1056808 | 2/1979 | Canada | 255/18 |

*Primary Examiner*—Stephen J. Novosad
*Assistant Examiner*—Hoang C. Dang
*Attorney, Agent, or Firm*—Hubbard, Thurman, Turner & Tucker

[57] ABSTRACT

Apparatus for injecting tubing into a subterranean well comprising a support frame for a pair of opposed endless conveyor chains fitted with tubing gripper blocks for gripping and conveying the tubing into and out of the well. The conveyor chains are supported by movable ramp members which are each connected to opposed hydraulic cylinder actuators hydraulically interconnected in parallel so that the ramp members may be moved toward and away from each other to uniformly vary the gripping force of the conveyor chains on the tubing. The endless conveyor chains are trained over idler sprockets which are interconnected by opposed hydraulic cylinder actuators for tensioning the chains with substantially equal tensioning forces. The conveyor assembly is mounted on a frame comprising two spaced apart metal plates which are reinforced by spaced apart vertical column members supported on a base. A guide mechanism for the tubing approaching the apparatus from a supply reel is provided with a series of spaced apart guide roller assemblies which are adapted to guide the tubing in both horizontal and vertical planes. The guide mechanism includes a support boom which is connected to the frame for swivelling movement to align the support boom with the injection tubing as it is paid out or back onto a supply reel. The conveyor chains are driven by sprockets connected to hydraulic motors connected in parallel.

30 Claims, 15 Drawing Figures

APPARATUS FOR INSERTING AND WITHDRAWING COILED TUBING WITH RESPECT TO A WELL

BACKGROUND OF THE INVENTION

1. Field of the Invention

The present invention pertains to a coiled tubing injection apparatus for inserting and removing a continuous length of tubing with respect to a well.

2. Background

In the development and production of subterranean hydrocarbon deposits and other energy sources there are many occasions when it is necessary to insert an elongated tube from the surface deep into the well from various purposes including, injection of certain types of fluids for stimulation of the production of hydrocarbon deposits, displacing fluids in the well, and for performing cleaning operations on the well production conduit and the like. In this regard, it is known to insert or inject a continuous length of relatively thin walled steel tubing into the well conduit from a large reel or spool on the surface. The forces required to inject or insert and to withdraw several thousand feet of tubing are substantial and various types of apparatus have been developed to perform this function.

As with other types of equipment used in the development and production of wells and in the rugged environment normally encountered in such work, there is an ever present need to increase the handling and performance capabilities and the reliability of such equipment without increasing its mechanical complexity. For example, in regard to tubing injection equipment the preferred concept comprises the provision of a pair of opposed endless flexible conveyor members or chains which are arranged to have elongated runs substantially parallel to each other and between which the tubing is straightened and propelled generally downward through a wellhead and into the well proper. It is, of course, necessary to provide a substantial gripping force on the tubing to perform the injection and withdrawal operations. In this regard, there has been a need to improve the general arrangement of and control of the endless conveyor chain or tubing gripper assemblies so that sufficient gripping forces may be applied uniformly along the opposed runs of the conveyor chains and whereby the gripping forces may be selectively controlled and equalized along the line of contact. Prior art tubing injection assemblies have been characterized by quite complicated arrangements of support rollers and actuator members for applying a biasing force against the opposed conveyor chain courses or runs which are engageable with the tubing. Moreover, prior art tubing injection apparatus have not provided for reliable and automatic compensation of chain tensioning to prevent chain breakage and to compensate for chain elongation.

Another problem assoicated with prior art tubing injector units pertains to the relatively heavy and complex framing or supporting structure associated with the endless chain assemblies. The type of equipment to which this invetion is directed must be highly portable and easily handled, and the reduction in the weight of the injector unit itself is very important in the overall approach to apparatus design.

Another desirable feature in tubing injector equipment pertains to the capability of the unit to handle more than one size or diameter of tubing. Since it is often necessary to change tubing size in order to fit the tubing within a certain size conduit or in order to increase the fluid handling capacity of the tubing, it is advantageous to be able to adapt the injector unit to handle the different tubing sizes.

Still another problem associated with the development of tubing injector apparatus is in the provision of means for guiding the tubing as it is uncoiled from the supply reel into the path between the gripping and conveying chain members so that the tubing is not substantially bent or kinked as it is paid off the supply reel and oriented for engagement with the opposed conveyor chain assemblies.

The aforementioned problems associated with prior art apparatus and desiderata realized from past experience with tubing injector apparatus are dealt with by the present invention which provides improved tubing injection apparatus having a number of important features.

SUMMARY OF THE INVENTION

The present invention provides an improved tubing injection and withdrawal apparatus for engaging and propelling a substantially continuous length of thin-walled steel tubing or the like into and out of a well.

In accordance with one aspect of the present invention there is provided a tubing injection and withdrawal apparatus having a unique frame structure which is relatively lightweight and combines the structural features and advantages of steel or metal plate members and hollow tubing column members for bearing the substantial pulldown and hoisting loads exerted by the apparatus. The tubing injector apparatus is also provided with a unique inner and outer frame configuration adapted to support opposed endless conveyor chains in such a way that the pulldown and hoisting forces, in particular, may be measured during operation of the apparatus. Moreover, the outer support frame is also adapted to support an improved drip pan for collecting excess lubricant which drips off of the apparatus and for collecting contaminants or debris dislodged from the tubing as it is worked in and out of a well.

In accordance with another aspect of the present invention there is provided a tubing injection apparatus having a pair of opposed endless flexible conveyor members supported on a frame by spaced apart sprockets and engaged by means adapted to exert equalized gripping forces on the tubing along a elongated contact path between the conveyor members. In a preferred embodiment of the invention each of the endless conveyor members are made up of roller chains and associated support rollers which are engaged with an elongated skate or ramp member having plural segments which are, respectively, connected to separate opposed hydraulic cylinder actuators interconnected hydraulically in parallel and arranged mechanically to equalize and balance the clamping or gripping forces exerted on the tubing. The arrangement of the ramp actuator cylinders also substantially eliminates any tendency to tilt or tip the ramps and the conveyor chains.

In accordance with yet another aspect of the present invention the endless conveyor chains are engaged with tensioning sprockets for maintaining the conveyor chains under a predetermined constant tension, to eliminate slack in the chains and promote longer chain life. Chain tension is maintained by idler sprockets engageable with each of the opposed gripping and conveying chains, which sprockets are engaged with a pair of opposed linearly extensible hydraulic cylinder actuators which are mechanically and hydraulically connected to provide a uniform equalized tension adjustment force exerted on the respective conveyor chains.

Still further in accordance with the present invention there is provided an improved drive mechanism for the gripping and conveying chains wherein a pair of hydraulic motor and brake units are mounted on a drive casing at the top of the inner support frame and are directly engaged with drive shafts for supporting and driving respective chain driving sprockets.

The invention also resides in an improved tubing guide mechanism which is provided with a plurality of spaced apart sets of opposed guide rollers mounted on support members which may be pivoted into and out of a working position so that selected ones of the guide roller sets may be utilized for guiding the tubing depending on the position of the supply reel with respect to the injector apparatus. The guide rollers are advantageously mounted on a curved support boom which is automatically positioned to orient the boom and the guide rollers with respect to the tubing supply reel to minimize deflection or bending of the tubing as it is paid off of or onto the supply reel.

Those skilled in the art will recognize and further appreciate the abovedescribed features and advantages of the present invention as well as other superior aspects thereof upon reading the detailed description which follows in conjunction with the drawing.

DESCRIPTION OF THE PREFERRED EMBODIMENT

Figure 1:
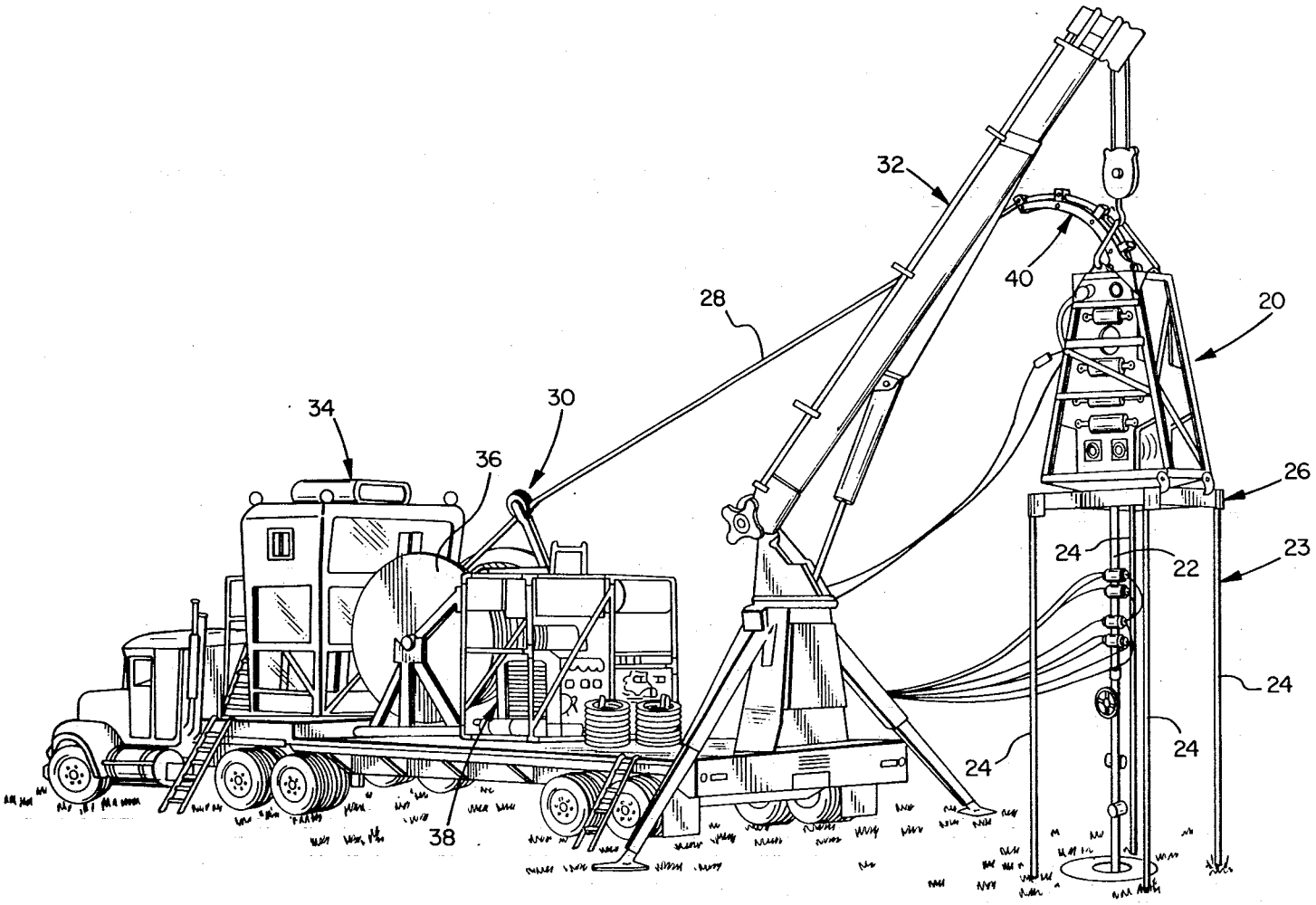
FIG. 1 is a perspective view of the tubing injection apparatus of the present invention shown in its working position and in combination with its support equipment.

In the description which follows like parts are marked throughout the specification and drawing with the same reference numerals, respectively. The drawing is not necessarily to scale and certain features in certain views of the drawing may be shown exaggerated in scale or in schematic form in the interest of clarity and conciseness.

Referring to FIG. 1, there is illustrated a coiled tubing injection apparatus in accordance with the present invention and generally designated by the numeral 20. The apparatus 20 is illustrated as being mounted in its working position above a wellhead 22 for a well for extraction of petroleum deposits, for example. The wellhead 22 is provided with a suitable column type support frame structure 23 having a plurality of spaced apart column members 24 which are adapted to support a sub-base member 26 for the apparatus 20 so that the apparatus is positioned directly over the wellhead 22 for injection and withdrawal of a substantially continuous length of coilable steel tubing, generally designated by the numeral 28 in FIG. 1. The wellhead 22 is typically provided with a suitable stuffing box, not shown, through which the tubing 28 is inserted in and withdrawn from the well.

The apparatus 20 is normally associated with support equipment including a tractor-trailer unit 30 on which a hydraulic boom crane 32 is mounted for handling the apparatus 20 when lifting the apparatus onto and off of the support structure 23, for example. The unit 30 includes a control cab 34 equipped with suitable controls including requisite hydraulic fluid flow control valves, not shown, for use in operating a hydraulic system associated with the apparatus 20 and described in further detail herein. The tubing 28 is supplied from a coiled condition on a reel 36 rotatably mounted on the unit 30. The unit 30 also includes a power source such an engine driven hydraulic pump, generally designated by the numeral 38. Those skilled in the art will appreciate that, in the operation of the apparatus 20, the continuous length of coiled tubing 28 is paid off of and onto the reel 36 and undergoes plastic deformation as it is somewhat straightened from a coiled condition on the reel 36 and then bent in a smooth curve as it courses through a tubing guide mechanism, generally designated by the numeral 40. The guide mechanism 40 is mounted on the apparatus 20 and the tubing 28 is fed from the guide mechanism to a gripper and conveyor mechanism whereby it is straightened and forcibly inserted into the wellhead 22.

Figure 2:
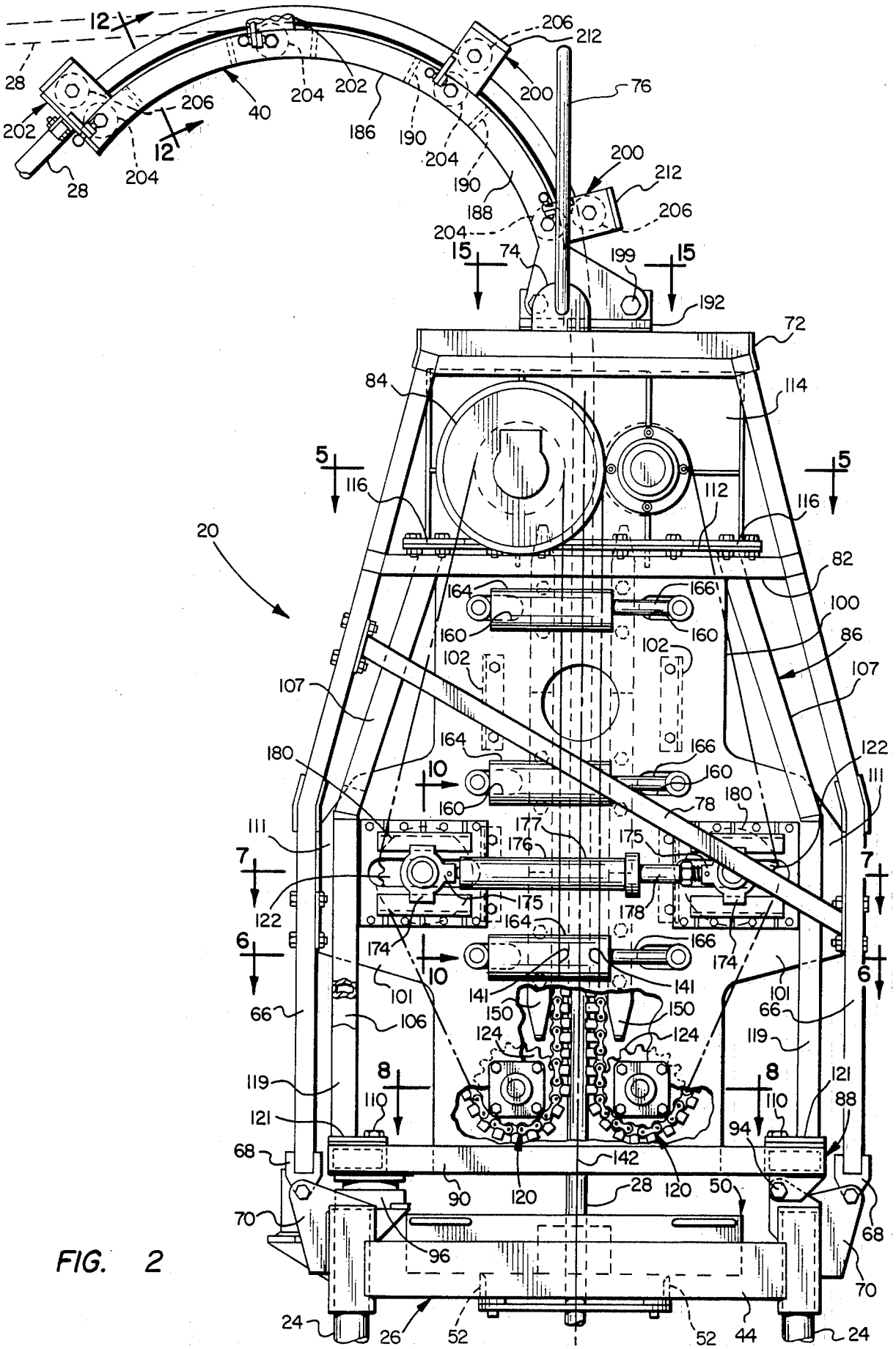
FIG. 2 is a side elevation of the tubing injection apparatus illustrated in FIG. 1.
Figure 3:
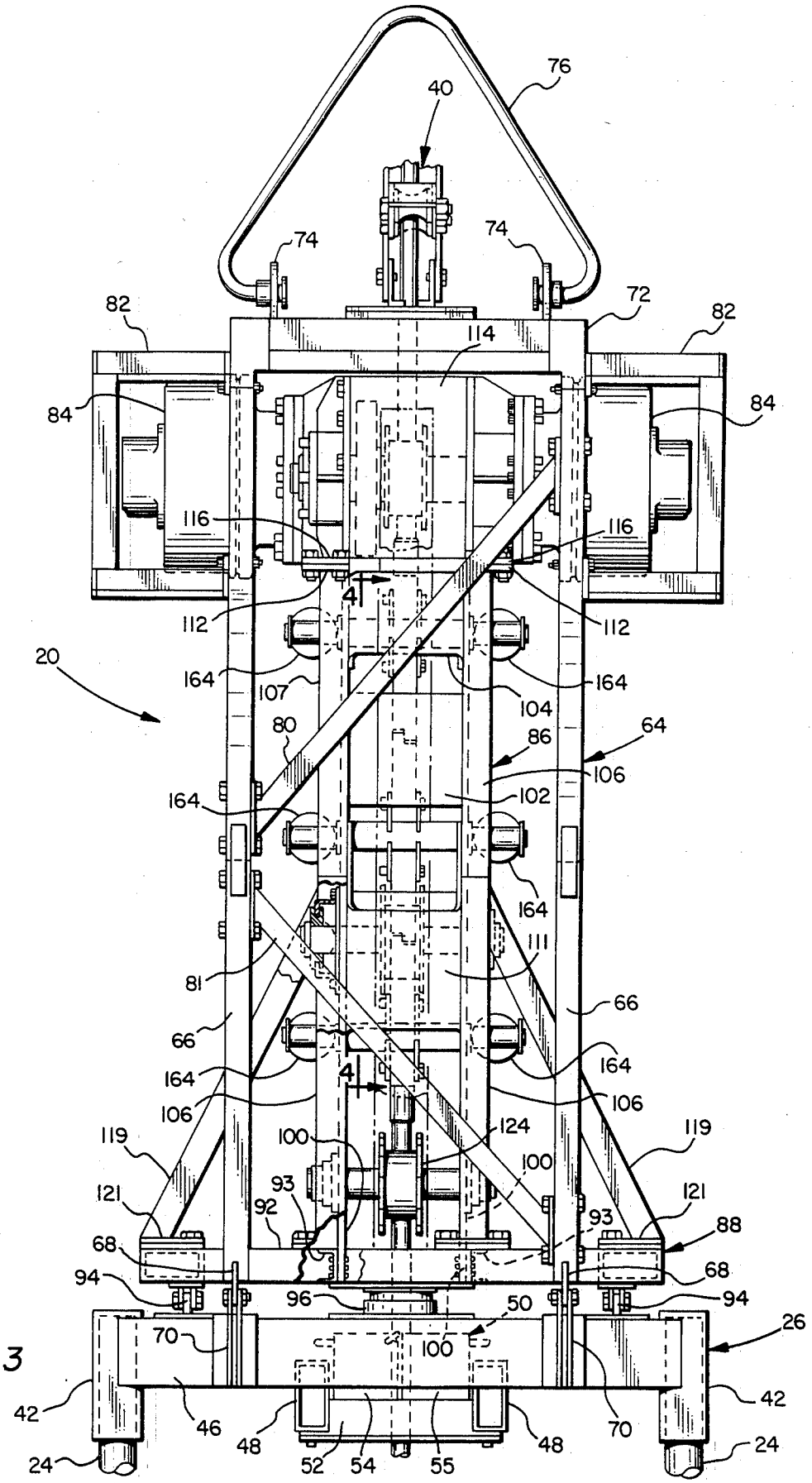
FIG. 3 is an end elevation view of the injection apparatus.

Referring now to FIGS. 2 and 3, in particular, the injection apparatus 20 is further characterized in that the sub-base 26 comprises a substantially rectangular perimeter frame member including four spaced apart cylindrical socket members 42 interconnected by beams 44 and 46. Secondary intermediate beams 48 extend parallel to the beams 44 and between the beams 46. The beam members 44, 46 and 48 are preferably comprised of rectangular steel tubing or the like suitably welded together and to the socket members 42 to form an integral structure which is adapted to be supported on the support columns 24 as indicated in FIGS. 1, 2 and 3.

Figure 14:
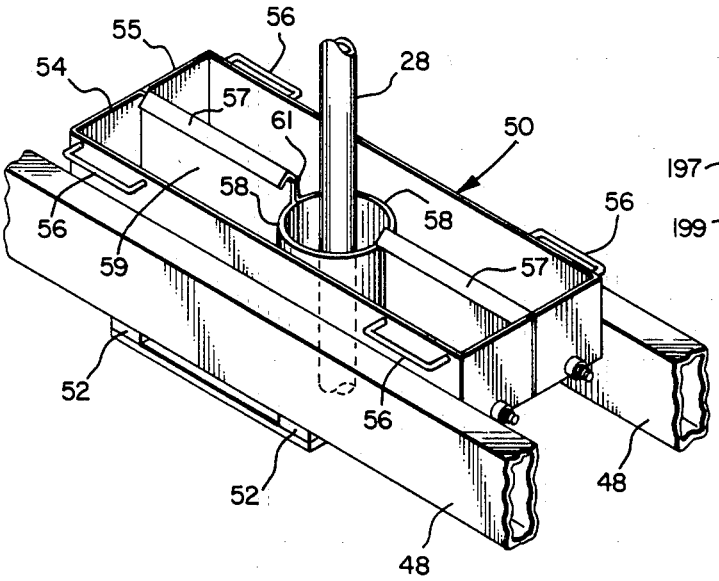
FIG. 14 is a detail perspective view showing the frame sub-base and drip pan.
Figure 15:
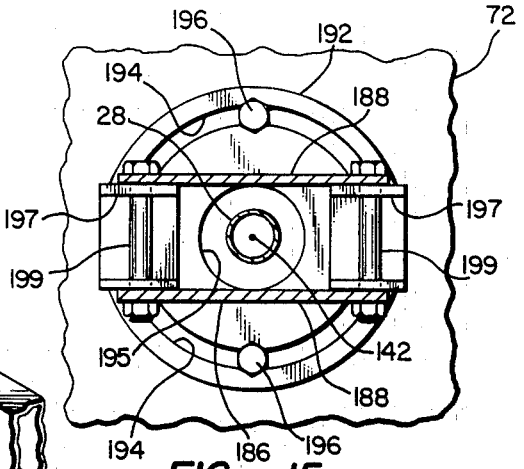
FIG. 15 is a detail section view taken along line 15—15 of FIG. 2.

Referring briefly to FIG. 14 also, the sub-base 26 is adapted to support a unique drip pan assembly, generally designated by the numberal 50, which is mounted between the beam members 48 on spaced apart support brackets 52 as shown in FIGS. 2 and 3. The drip pan 50 is characterized by two separate panlike containers 54 and 55 which are provided with suitable lifting handles 56. Each of the drip pan containers 54 and 55 includes a central arcuate wall portion 58 disposed along adjacent sidewalls 59 and 61 of the containers and forming a clearance recess 60 for the tubing 28 and primarily for a stuffing box or so called stripper mechanism, not shown. The container 55 includes spaced apart integral lip portions 57 formed along the upper edge of the sidewall 61 which overlap the adjacent sidewall 59 of the container 54, as shown in FIG. 14. The drip pan assembly 50 may be easily set in place on top of the support brackets 52 and maintained in position between the beam members 48 for collecting liquid lubricant dripping off of the mechanism of the injection apparatus 20 and for collecting other debris which may be clinging to the tubing 28 as it is being run through the apparatus 20. The containers 55 and 54 may be removed, preferably in sequence, from the working position shown in FIGS. 2, 3 and 14 and replaced without disassembly of the apparatus 20 for emptying and cleaning.

Referring again primarily to FIGS. 2 and 3, the apparatus 20 is also characterized by an outer lifting frame, generally designated by the numeral 64. The frame 64 includes the sub-base 26 and a plurality of spaced apart generally vertically extending column members 66 characterized as rectangular cross-section steel tubes. The column members 66 are each connected at their lower ends by suitable brackets 68 to clevis members 70 suitably welded to the sub-base beam members 46. The tubular column members 66 extend upwardly toward and are connected to a suitable weldment 72 on which a pair of spaced apart upstanding brackets 74 are secured and are adapted to journal opposite ends of a tubular lifting bail 76. The column members 66 are also interconnected by a plurality of lacings or stiffening members 78, 80 and 81, as indicated in FIGS. 2 and 3, respectively. The frame 64 also includes opposed perimeter type guard sections 82, FIG. 3, which are secured to adjacent ones of the column members 66 and are adapted to form protective structure for a pair of opposed hydraulic motors, each generally designated by the numeral 84. The motors 84 are part of a drive mechanism for the injection apparatus 20 which will be described in further detail herein.

Figure 6:
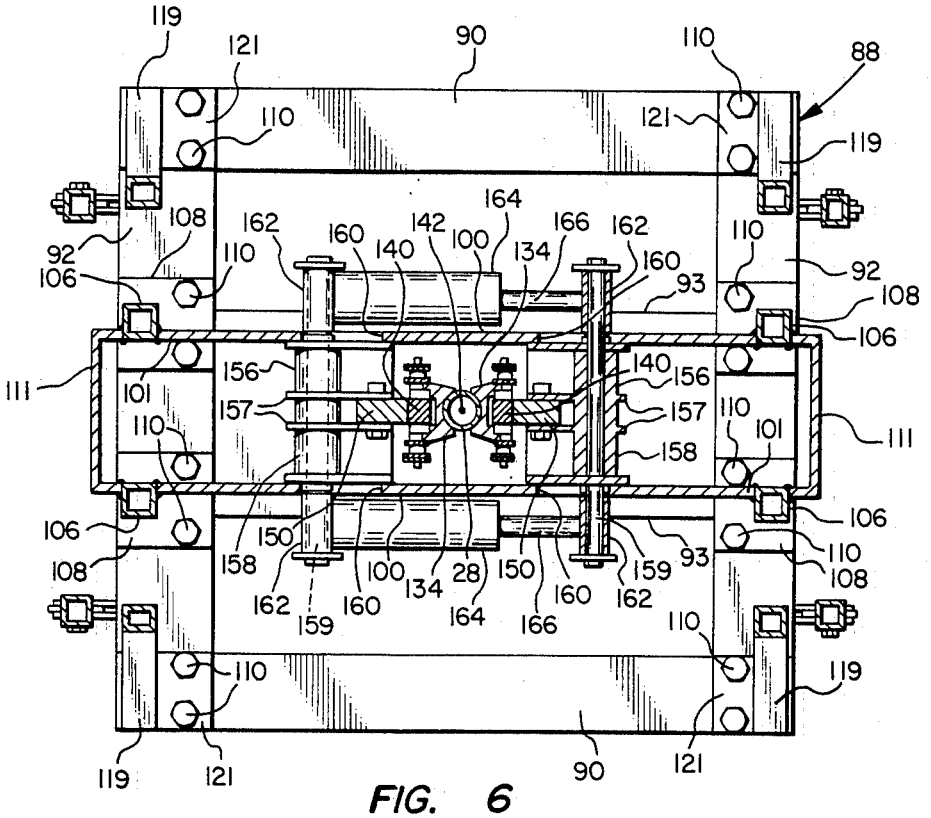
FIG. 6 is a section view taken along the line 6—6 of FIG. 2.
Figure 7:
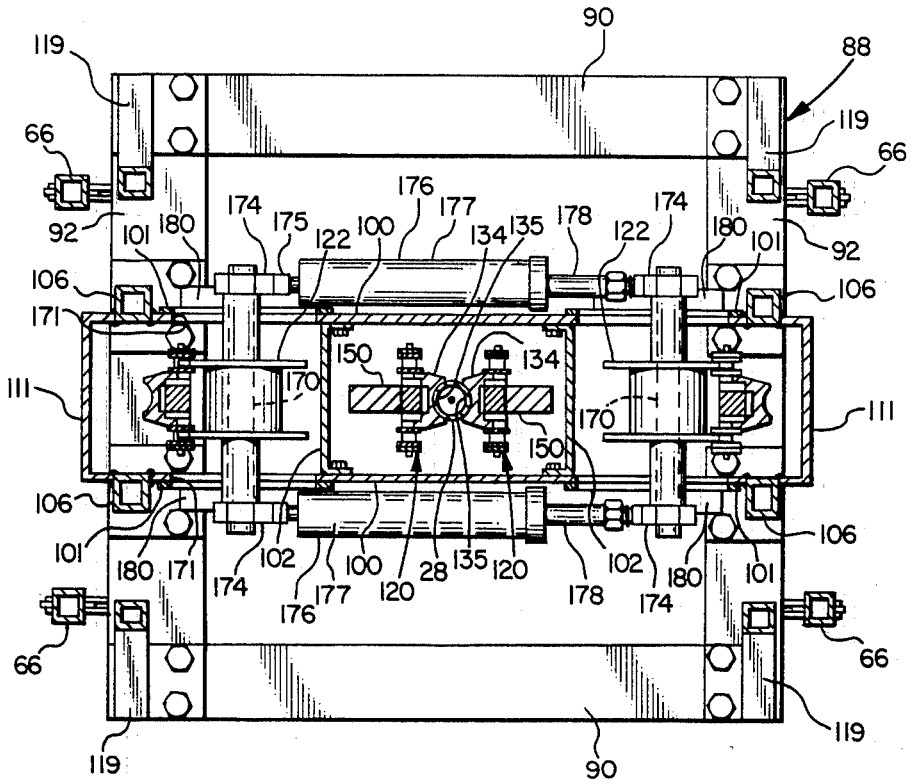
FIG. 7 is a section view taken along the line 7—7 of FIG. 2.

Referring further to FIGS. 2 and 3, and also FIGS. 6 and 7, the tubing injection apparatus 20 is also characterized by an inner support frame, generally designated by the numeral 86. The frame 86 includes a rectangular perimeter base member 88 made of rectangular cross-section tubular members 90 and 92, see FIGS. 6 and 7 in particular, suitably secured together by mitered corner joints, not shown, which are welded. As shown in FIGS. 3 and 6, intermediate spaced apart channel shaped stringers 93 extend between the base members 92 and are suitably welded thereto.

The base 88 is supported on the sub-base member 26 at respective hinges 94, FIGS. 2 and 3, which are connected to one of the beam members 46 and one of the members 92 of the base 88. The opposite members 46 and 92 are held spaced apart by a force sensing element 96 adapted to at least partially support the frame 86 with respect to the sub-base member 26 and also to transmit a signal proportional to forces exerted between the frame 86 and the sub-base member 26 when the apparatus 20 is operative. The force sensing element 96 may be a model SW6F-16 made by Martin-Decker/Cooper Industries, Santa Ana, Calif.

The inner support frame 86 also includes a pair of spaced apart vertically extending metal plate members 100 which are interconnected by opposed channel shaped web members 102, FIG. 7, and gussets 104, one shown in FIG. 3, to maintain the plates 100 suitably spaced apart and rigidly secured to each other. The lower edges of the plate members 100 are secured, respectively, to the frame stringers 93, as shown in FIG. 3 also. The support frame 86 also includes substantially vertically extending rectangular cross-section tubular column members 106 which are each provided inwardly extending upper sections 107, FIG. 2, and with a pedestal 108, FIG. 6, adapted to be suitably secured to respective ones of the perimeter members 90 ad 92 by threaded bolts 110, FIG. 6. The column members 106 are welded to laterally projecting wing portions 101 of the plates 100, as indicated in FIGS. 6 and 7. Opposed gusset members 111 are also suitably welded to opposite sides of the column members 106 along their contiguous surfaces to further strengthen the frame 86.

Figure 5:
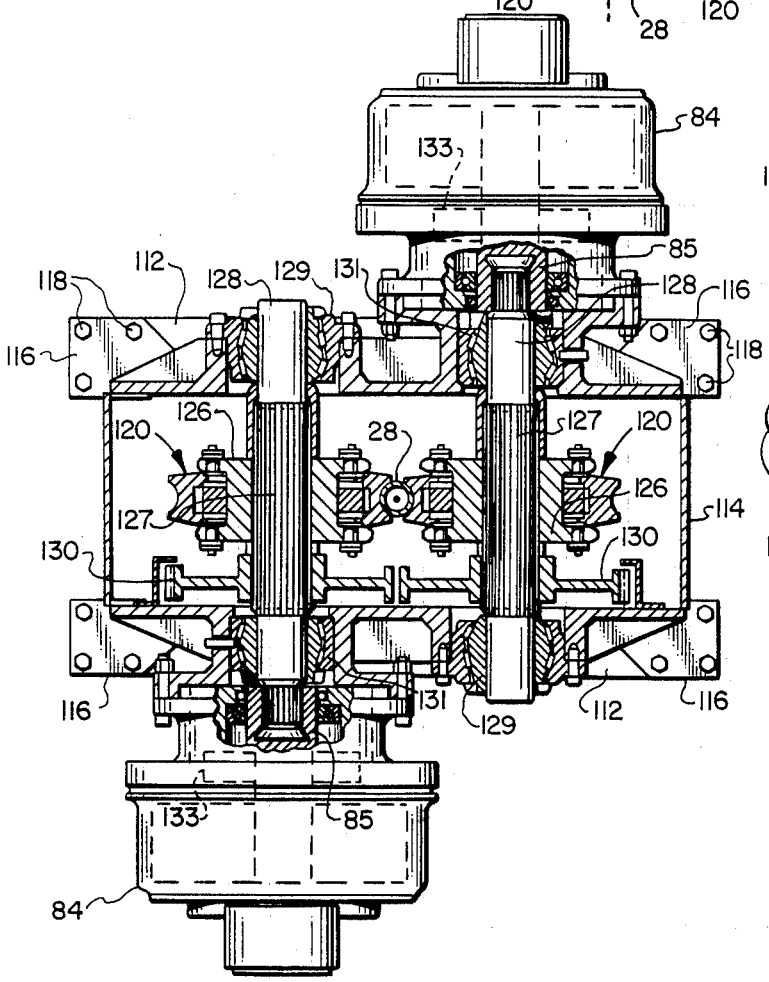
FIG. 5 is a section view taken along the line 5—5 of FIG. 2.

Referring to FIGS. 2 and 3, the column members 106—107 extend upwardly adjacent to the frame plates 100 and are in supportive relatonship to a pair of opposed horizontal flanges 112 extending along respective ones of the frame plates 100 and adapted to support a drive assembly including a bottomless housing 114 for the drive motors 84. Referring to FIG. 5 also, the housing 114 includes cooperating flange portions 116 which are juxtaposed to the flanges 112 for supporting the drive assembly on the innner frame 86. Suitable bolts 118 are provided to secure the drive housing 114 to the flanges 112. Referring to FIGS. 2, 3 and 6, the inner frame 86 also includes vertically extending angled brace members 119 which extend upward from support pedestals 121 and are suitably secured to the column members 106 as by welding the upper ends of the brace members 119 to the column members 106. The pedestals 121 are also secured to the base 88 by bolts 110.

Figure 8:
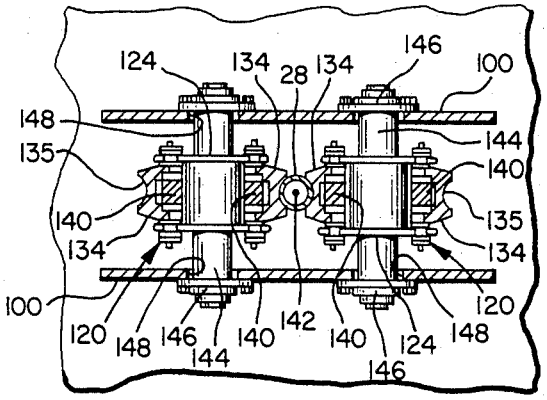
FIG. 8 is a section view taken along the line 8—8 of FIG. 2.

Referring now to FIGS. 2, 5 and 8, the tubing injection apparatus 20 is also characterized by a pair of opposed endless flexible conveyor members, each generally designated by the numeral 120, which are disposed between the frame plates 100 and are trained over respective double idler sprockets 122 and 124 rotatably supported by and between the plates 100. The conveyor members 120 are each, respectively, drivably engaged with double drive sprockets 126, FIG. 5. The drive sprockets 126 are each mounted on respective drive shafts 128 which are journalled in self-aligning type antifriction bearing assemblies 129 and 131 supported on and removable from the drive housing 114. The drive shafts 128 are each drivenly connected to one of the motors 84, as indicated, by cooperating splines on the shaft ends and on the motor output shafts 85. The drive shafts 128 each also include splined portions 127 for drivingly connecting the shafts to the sprockets 126 and to respective intermeshed synchronization gears 130 so that the relationship of the opposed conveyor members 120 remains in synchronization and pulldown and hoisting loads exerted on the tubing 28 are substantially equalized between the conveyor members 120. As indicated in FIGS. 2 and 5, the bottom of the drive casing 114 is open to permit clearance for the conveyor members 120 as they are trained around the sprockets 126. The drive motors 84 are preferably a positive displacement hydrostatic type motor, each equipped with wet multidisc type static brakes 133 which are hydraulically releasable and are formed as an integral part of the motors. The motors 84 are preferably of a type manufactured by Poclain Hydraulics, Fredricksburg, Va., as their models H20 or H25. The arrangement of the drive motor 84 and their associated brakes 133 is advantageous in that the brakes are mounted for controlling rotation of the drive shafts 128 directly and provide a compact arrangement. The provision of the brakes 133 is important to prevent unwanted payout of tubing into the well bore. Moreover, the entire motor and brake assembly contained in each of the motors 84 may be easily replaced by unbolting the motors from the housing 114 and replacing the motors with larger or smaller capacity motors required for differenct sizes of tubing to be injected by the apparatus 20. In such situations the conveyor members 120 are normally interchanged with other conveyor members also. The sprockets 126 and gears 130 may be easily mounted on and removed from the respective shafts 128 thanks to the splined connections between these parts and the respective shafts.

Figure 9:
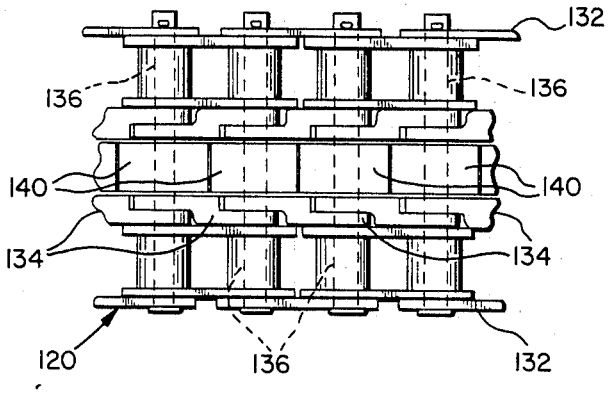
FIG. 9 is a detail view of a section of one of the conveyor chains used in conjuction with the apparatus illustrated in FIGS. 1 through 8.

Referring briefly to FIG. 9, there is illustrated a detail of a portion of one of the conveyor members 120. The conveyor members 120 are each made up of a pair of spaced apart endless roller chains 132 which are interconnected with each other and with a series of tubing gripper blocks 134 by elongated cylindrical pins 136. The chains 132 are of substantially conventional industrial roller chain design and are adapted to be interconnected, as indicated, with the gripper blocks 134 which are configured such that the blocks may be nested one within the other as illustrated. Each block 134 is also provided with a support roller 140 which is rotatably mounted on a pin 136. The aforementioned sprockets 122, 124 and 126 are thus all of the type having double sets of sprocket teeth for engaging the respective chain assemblies 132. The gripper blocks 134 are each provided with an arcuate recess 135, see FIG. 8, having a radius of curvature of the recess only slightly larger than and conforming substantially to the radius of curvature of the tubing 28. Accordingly, the blocks 134 may be disposed in close fitting gripping relationship to the tubing 28 along a linear path portion disposed between opposed parallel vertical runs of the conveyor members 120. Each of the conveyor runs is designated by the numeral 141 in FIGS. 2 and 4. The tubing 28 is thus fed vertically along a linear path coinciding with an axis 142, FIGS. 2, 4, 5, 6 and 8, which axis extends vertically between the frame plates 100 and between the conveyor runs 141 through the apparatus 20.

Referring further to FIG. 8, the sprockets 124 are each mounted on a suitable shaft 144 for rotation therewith. The shafts 144 project through suitable clearance holes 148 in the frame plates 100 and are each rotatably supported in respective pillow block bearing assemblies 146 mounted on the outer sides of the respective frame plates 100, as shown. Accordingly, the opposite ends of the conveyor runs 121 are delimited by the respective sprocket sets 124 and 126 which are essentially non-adjustable as regards accommodating or modifying any slack in the conveyor members 120. However, the conveyor members 120 must be of a length sufficient to provide for adjustment of slack in the members so that, along the conveyor runs 141, the gripper blocks 134 may be forcibly engaged uniformly with the tubing 28 as it progresses along the axis 142. Respective mechanisms for adjusting the gripping force exerted on the tubing 28 by the conveyor members 120 along the portion of the tubing feed path formed by the runs 141, and for adjusting slack or tension in the conveyor members 120 will now be described in conjunction with FIGS. 2 through 4, 6 and 7.

Figure 4:
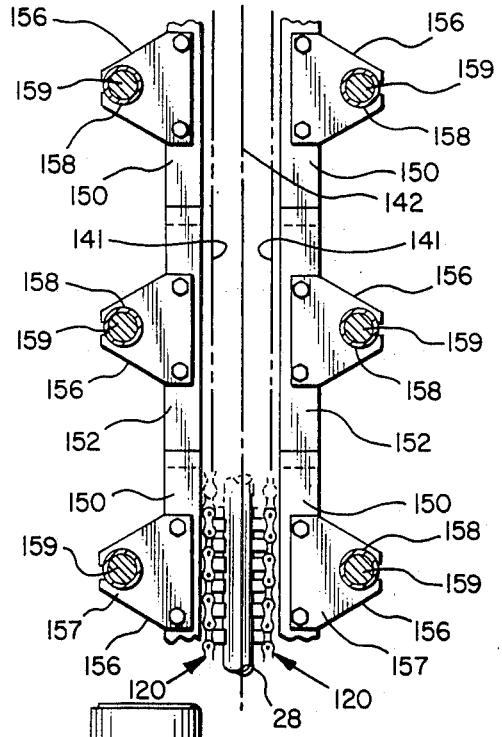
FIG. 4 is a detail section view taken along the line 4—4 of FIG. 3.

Referring briefly to FIG. 4, the conveyor runs 141 are each provided with support means for the conveyor members 120 comprising a plurality of elongated opposed skate or ramp members 150, and 152. Each conveyor run 141 is provided with opposed ramp members 150 at opposite ends of the run and a intermediate ramp member 152. The ramp members 150 and 152 form a substantially continuous support surface for the rollers 140 for supporting the conveyor members 120, and the gripper blocks 134 for gripping engagement with the tubing 28 as it progresses along the runs 141.

Referring to FIG. 4, and to FIG. 6 by way of example, the ramp members 150 are each mounted on a support bracket 156 including a pair of spaced apart plates 157 interconnected by an elongated tubular sleeve 158. The brackets 156 are each adapted to journal an elongated cylindrical shaft 159 which extends perpendicular to the axis 142 and projects through opposed elongated slots 160 and formed in the plates 100, respectively. The shafts 159 also extend through opposed tubular sleeve members 162 which are each secured to one end of a hydraulic cylinder and piston assembly 164 including a linear extensible piston rod 166. The piston rods 166 are also secured at their distal ends to sleeve members 163 which journal the other of the shafts 159, as indicated in FIG. 6. The shafts 159 are retained in assembly with the sleeves 162 and 163, respectively, by suitable retaining rings disposed on the opposite ends of the shafts.

The arrangement illustrated in FIG. 6 is exemplary of the manner in which each of the opposed sets of ramp members 150 and 152 are supported on the inner frame 86. Accordingly, in response to actuation of the hydraulic cylinder actuators 164 to draw the piston rods 166 into their associated cylinder members the opposed sets of ramp members 150 and 152 are biased to move toward each other along the conveyor runs 141 to cause the conveyor members 120 to forcibly grip the tubing 28 as it passes along the axis 142. Those skilled in the art will appreciate that the mounting arrangement of the cylinder assemblies 164 is such that the structure for causing the conveyor members 120 to grip the tubing 28 is substantially self centering and load equalizing thanks, in part, to the hydraulic circuit arrangement which will be described in further detail herein. The cylinders 164 are hydraulically connected in parallel so that the forces exerted by each cylinder on the opposed ramp members 150 and 152 are substantially equal. Therefore, uniform loading on the tubing 28 by the conveyor members 120 along the runs 141 may be easily and reliably accomplished and there is no tendency to tilt or twist the ramp members about their respective longitudinal axes.

Figure 10:
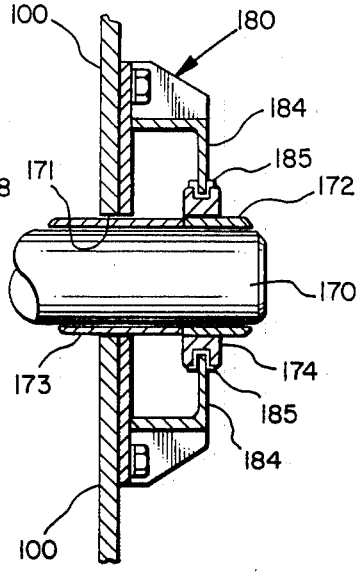
FIG. 10 is a detail section view taken along the line 10—10 of FIG. 2.

Referring now to FIGS. 7 and 10, in particular, the conveyor members 120 are adjusted to reduce slack or increase tension in the conveyor members by linear extension of the sprockets 122 in a direction away from each other and substantially perpendicular to the axis 142. As shown in FIG. 7, the sprockets 122 are each suitably keyed to a shaft 170 which projects from each side of its respective sprocket through elongated slots 171 in the plates 100. As shown by way of example in FIG. 10, the opposed ends of each shaft 170 also project through spacer sleeves 173 and are journalled in a bearing 172. Each of the bearings 172 is mounted in a bearing housing 174 having a laterally projecting boss 175, FIGS. 2 and 7, secured, respectively, to one end of a hydraulic cylinder assembly 176 including a cylinder member 177 and a linearly extensible piston rod 178. As shown in FIG. 10, again by way of example, each of the bearing housings 174 is slidably supported on a guide assembly 180 secured to the frame plate 100. Each bearing guide 180 includes opposed angle section guide members 184 which are disposed in supportive relationship to the bearing housing 174 and extend into channel shaped bushings 185 fitted in suitable longitudinal grooves formed in the bearing housings 174 whereby the bearing housings may each be slidably guided along the guide members 184. The view of FIG. 10 is exemplary as each of the bearing housings 174 is similarly supported in a cooperating guide member 180 arranged as indicated in FIGS. 2 and 7.

The cylinders 176 are preferably operated in a hydraulic circuit in parallel with each other to extend their respective piston rods 178 to exert a force on the respective sprockets 122 biasing them away from each other and from the axis 142 to suitably tension the conveyor members 120. The free floating arrangement of the cylinders 176 provides for equal tension loading on the respective conveyor members 120 and load equalization between the respective cylinders to eliminate any tendency to skew the sprockets 122. Accordingly, the conveyor members 120 may be selectively tensioned to eliminate any slack in the conveyor members and to accommodate variations in loading on the conveyor members by the cylinders 164 and the associated ramp members 150 and 152.

Referring now to FIGS. 2, 11, 12 and 15, the tubing guide mechanism 40 comprises an elongated arcuate boom 186 characterized by a pair of spaced apart curved flanges 188 which are suitably interconnected by spaced apart webs 190. The boom 186 is adapted to be mounted on the weldment 72 by a cylindrical bearing plate 192, FIG. 15, which is supported on the weldment 72 and is provided with opposed arcuate grooves 194 and a centrally disposed clearance hole 195 for the tubing 28. Opposed hex head fasteners 196 extend through the grooves 194 and are suitably securred to the weldment 72 to retain the bearing plate 192 on the weldment and to provide for limited pivotal movement of the bearing plate and the guide boom 186 about the axis 142. As shown also in FIG. 15, the flanges 188 are secured to spaced apart channel shaped brackets 197, forming part of the bearing plate 192, by bolt and nut assemblies 199.

As shown in FIG. 2, the boom 186 is provided with a plurality of circumferentially spaced apart tubing guide roller assemblies 200 and 202. The guide roller assemblies 200 and 202 are substantially identical with the exception that the guide roller assemblies 202 include two sets of guide rollers to control excursion of the tubing 28 in two directions whereas the guide roller assemblies 200 are provided with only one set of guide rollers to journal the tubing to prevent unwanted excursion of the tubing in a substantially vertical plane. As shown by way of example for a guide roller assembly 202 in FIGS. 11 and 12, each of the guide roller assemblies 200 and 202 include opposed tubing guide rollers 204 and 206 which are substantially identical and are formed with a somewhat "v" shaped groove for centering the tubing 28 between the rollers. The guide rollers 204 are rotatably mounted between the flanges 188 on suitable bearing shafts 210 which are also configured as hex head bolt and nut assemblies. The shafts 210 are each provided with a suitable lubricant passage, not shown, in communication with lubricant fittings 211 whereby the guide rollers 204 may be periodically lubricated.

Figure 11:
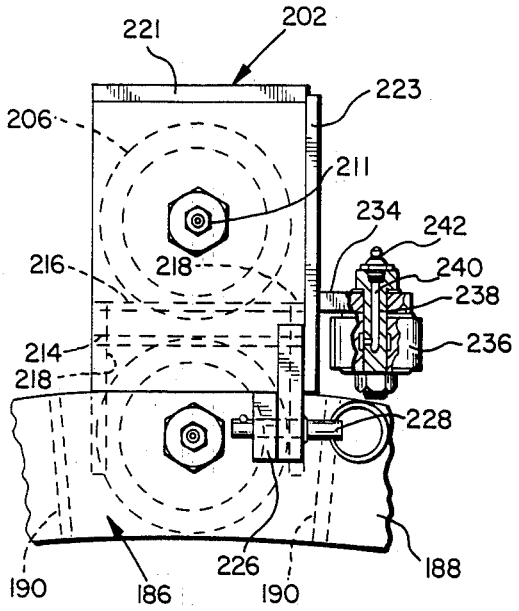
FIG. 11 is a detail side elevation of one of the guide roller assemblies for the tubing guide boom.
Figure 12:
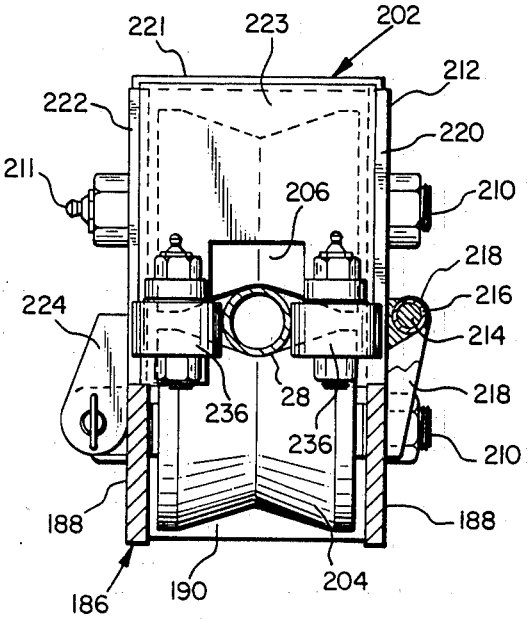
FIG. 12 is an end view of one of the guide roller assemblies taken from the line 12—12 of FIG. 11.

The guide rollers 206 are each also rotatably mounted on a shaft 210 supported on a rectangular boxlike support housing 212. The housings 212 are pivotally secured on the boom 186 by a hinge comprising a cylindrical pin 214 journalled by a bearing sleeve 216 and a pair of spaced apart support brackets 218. The support brackets 218 are secured to one of the flanges 188 and the bearing sleeve 216 is suitably welded to a sidewall 220 of the housing 212. The housing 212 includes a second sidewall 222 spaced from and generally parallel to the sidewall 220 and interconnected with the sidewall 220 by a top part 221 and a backwall 223. The front side of the housing 212 is open. The sidewall 222 is provided with a first latch member 224 cooperable with a second latch member 226 mounted on the flange 188 opposite the flange supporting the brackets 218 as shown in FIGS. 11 and 12. The latch members 224 and 226 are each provided with suitable bores for receiving a removable latch pin 228 whereby the housing 212 may be locked in the position shown in FIGS. 11 and 12 for journalling the tubing 28 between the rollers 204 and 206. However, the housings 212 may be pivoted about the pivot axis of the hinge pin 214 to an open position substantially clear of the tubing path whereby the tubing 28 may be trained along or removed from the guide mechanism 40. Depending on the position of the tubing supply reel 36 with respect to the apparatus 20, one or more of the housings 212 may be left in the open position and clear of the tubing 28 so that as the tubing approaches the guide mechanism 40 it may not be subjected to undo bending stresses. An alternate position of approach of the tubing 28 to the guide mechanism 40 is indicated by the dashed lines in FIG. 2, by way of example.

Referring further to FIGS. 11 and 12, the housings 212 for each of the guide rollers assemblies 202 are further modified by the provision of two spaced apart support brackets 234 mounted on the backwall 223 and adapted to support guide rollers 236. The rollers 236 are each supported by a shaft 238 secured to the brackets 234 and also provided with lubricant passage means 240 and a conventional lubricant fitting 242, as indicated in FIG. 11. The rollers 236 are spaced apart sufficiently to substantially centralize the tubing 28 between the rollers 204 and 206 and to prevent lateral excursion of the tubing 28 in a plane perpendicular to the plane in which the rollers 204 and 206 provide guidance. Accordingly, the tubing 28 is carefully guided in a smooth arcuate path as it approaches the vertical direction to be gripped between the conveyor members 120 along the respective conveyor runs 141 and without the prospect of kinking or being subjected to undo bending stresses. Thanks to the provision of the boom 186, which is mounted on the apparatus 20 by the swivel bearing plate 192, the guide mechanism 40 may also be adjusted to be aligned with the path of the tubing 28 with respect to the location of the reel 36 and as it is paid off of or wound back onto the reel, without unduly stressing or bending the tubing. Those skilled in the art will appreciate that the guide roller assemblies 200 may also be supplied with the guide rollers 236, although they are not normally needed as long as one or both of the guide roller assemblies 202 are utilized to serve as a fairlead for initial guidance of the tubing between the guide mechanism 40 and the supply reel 36.

Figure 13:
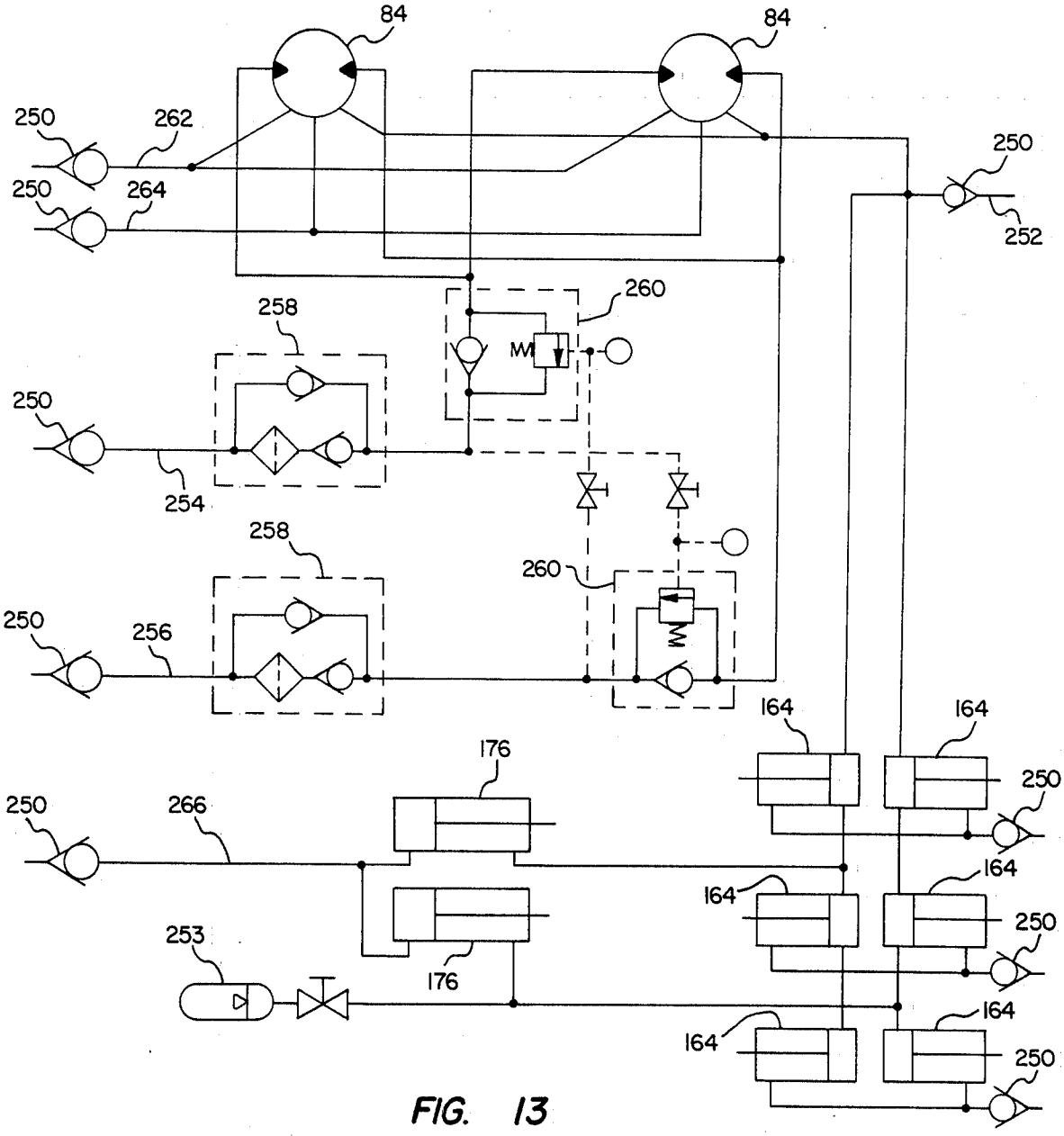
FIG. 13 is a schematic diagram of a portion of the hydraulic control circuit for the tubing injection apparatus.

Referring now to FIG. 13, there is illustrated a schematic diagram of a portion of the hydraulic circuitry used to operate the tubing injection apparatus 20. The portion of the hydraulic system illustrated in FIG. 13 is adapted to be onboard the apparatus 20 and is connected to a source of hydraulic fluid such as the engine driven pump unit 38 by way of a control console located at the cab 34. Suitable control valves associated with the control console, not shown, are adapted to valve hydraulic fluid to the components illustrated in FIG. 13 and are believed to be readily understandable by those skilled in the art. FIG. 13 illustrates a hydraulic circuit including a number of hydraulic flow lines each of which are provided with quick disconnect type couplings 250 for connecting the respective lines to the source of hydraulic fluid by way of the aforementioned console. The flow line 252 indicated in FIG. 13 is a low pressure return line which is operable to conduct leakage flow from the cylinder actuators 164 and 176 to a reservoir for hydraulic fluid, not shown. The line 252 is also connected to the respective motors 84 to conduct normal leakage and drain flow as well as control fluid flow from the motors to the aforementioned reservoir.

The motors 84 are each adapted to be connected to respective lines 254 and 256 which have the dual function of being a fluid supply or return line depending on the direction of rotation of the motors. Each of the lines 254 and 256 includes a filter unit 258 and a counterbalance valve 260 interposed therein, respectively. The motors 84 are also connected to respective control fluid supply lines 262 and 264 which, respectively, are operable to control the spring set-hydraulically releasable brakes 133 associated with each of the motors, and a motor displacement control mechanism, not shown, to provide for low speed relatively high torque operation and high speed relatively low torque operation of the respective motors. As will be appreciated from the schematic diagram of FIG. 13, the motors 84 are connected in parallel in regard to their brake and displacement control functions as well as in regard to the supply and return of main line power hydraulic fluid by way of the lines 254 and 256. As will also be appreciated by those skilled in the art the cylinder actuators 176 are connected in parallel to the aforementioned source of hydraulic fluid by way of a supply line 266 and a suitable pressure regulator valve, not shown. Each set of hydraulic actuators 164 associated with a ramp member 150 or 152 is also connected in parallel and, in fact, all of the actuators 164 are adapted to receive fluid from a common supply line by way of a control valve located at the control console, not shown, so that fluid pressure acting on each of the cylinder actuators 164 is essentially the same. The return line 252 is also in communication with an accumulator 253 to prevent any pressure surges in the return line circuit from adversely effecting the operation of the actuators 164 and 176. Accordingly, the gripping action of the conveyor members 120 is controlled by controlling the pressure of hydraulic fluid supplied to the actuators 164, the tension in the conveyor members 120 is controlled by controlling the pressure of fluid in the line 266, and the operation of the motors 84 in unison is controlled by controlling the supply of pressure fluid to the lines 254 or 256 in conjunction with operation of the brakes 133 and the displacement control features of the respective motors.

The overall operation of the apparatus 20 is believed to be readily understandable to those skilled in the art from the foregoing description. However, upon positioning the tractor/trailer unit 30 adjacent to the wellhead 22 as illustrated in FIG. 1, the crane 32 is suitably connected to the lifting frame 64 of the apparatus 20 to position the apparatus on the wellhead and supported by the column members 24. The tractor/trailer unit 30 is preferably positioned with respect to the wellhead 22 initially such that the tubing 28 may be unrolled from the reel 36 and trained through the guide mechanism 40 while permitting the boom 186 to be rotated about the axis of bearing plate 192 sufficiently to allow the guide mechanism to be aligned with the tubing being paid off of the reel under substantially all conditions. Upon installation of the apparatus 20 on the wellhead 22, the various control lines described in conjunction with FIG. 13 are connected to the apparatus together with a control line for the load or force sensing element 96 and suitable lines, not shown,, for providing forced lubrication to the conveyor members 120 and the drive gearing.

Prior to threading the tubing 28 between the conveyor runs 141, the cylinder actuators 164 and 176 will be retracted sufficiently to permit some slack in the conveyors 120 and to allow the ramps 150 and 152 to retract sufficiently to permit easily threading the tubing through the apparatus 20. The housings 212 for the respective guide roller assemblies 200 and 202 will also be unlatched and pivoted to their open positions to permit initial threading of the tubing 28 through the guide mechanism 40. Once the tubing 28 has been threaded completely through the apparatus 20 and inserted into the wellhead structure the conveyor members 120 may be snugged up by applying pressure fluid to the actuators 164. As the conveyor members 120 are tightened, observation of the blocks 134 will be made to be sure that they suitably journal the tubing 18. The tubing 28 is also then laid in the proper position on the guide rollers 204 in the guide mechanism 40 and the housings 212 are closed and locked by their respective latch pins 228. Of course, depending on the relative position of the reel 36 with respect to the guide mechanism 40, the guide roller assembly 202 at the the distal end of the boom 186 may be deactivated by leaving its housing 212 in the open position depending on the directional attitude of the tubing at that point.

With the tubing 28 in position for injection by operation of the motors 84 gripping action on the tubing may be selectively controlled by controlling the pressure applied to the actuators 164 and chain tension may be also adjusted by pressurization of the actuators 176. The tubing 28 may then be injected into the well by operation of the motors 84 to cause the conveyor members 120 to traverse the tubing 28 generally vertically downwardly. The force with which the tubing is being injected may be monitored by a signal transmitted from the force sensing element or load cell 96 and the tubing continuously injected until the lower end reaches the desired location for utilization of the tubing in accordance with its intended function.

When it is desired to withdraw the tubing 28 the direction of rotation of the motors 84 is simply reversed and the gripping action of the conveyors 120 and the blocks 121 adjusted to eliminate any slippage between the conveyor members 120 and the tubing. The output signal from the force sensing element 96 is further monitored to prevent separation of the tubing 28 due to exceeding the tensile strength of the tubing with the withdrawal pulling effort. Thanks to the unique configuration of the inner frame 86 tubing pulldown and hoist reaction loads are substantially uniformly transmitted by the frame plates 100 and the column members 106-107 to the base member 88 without distortion of the frame 86 and any resulting misalignment of the sprockets 122, 124 and 126.

Although a preferred embodiment of the present invention has been described in detail herein those skilled in the art will recognize that various substitutions and modifications may be made to the specific embodiment disclosed without departing from the scope and spirit of the invention as defined by the appended claims.

What we claim is:

1. Apparatus for injecting and withdrawing means forming a substantially continuous length of tubing into and from a well, respectively, said apparatus including:

a frame;

a pair of opposed endless flexible conveyor members supported on said frame and having opposed elongated parallel runs spaced apart to form a path for engagement of said tubing by gripper means on said conveyor nembers, said conveyor members being trained over spaced apart drive sprocket means and idler sprocket means associated with respective ones of said conveyor members;

said frame including a base member, a pair of spaced apart upstanding plate members supported on and secured to said base member and supporting therebetween said conveyor members and at least one of said sprocket means for each of said conveyor members, and spaced apart generally vertically extending column members supported on and secured to said base member, said column members being disposed along opposite vertical sides of each of said plate members and connected to said plate members, respectively, for transmitting at least a portion of reaction pulldown and hoist loads from said plate members to said base member during operation of said apparatus to move said tubing into and out of said well;

a sub-base member disposed under said base member and including means for supporting said base member on said sub-base member for movement relative to said sub-base member, and load sensing means interposed between said base member and said sub-base member for measuring reaction loads on said frame due to at least one of injecting and withdrawing said tubing with respect to said well.

2. The apparatus set forth in claim 1 including:

an elongated brace member extending upward from said base member at each vertical side edge of each of said plate members and connected at its upper end to one of said column members.

3. The apparatus set forth in claim 2 wherein:

said column members are tubular.

4. The apparatus set forth in claim 2 wherein:

said brace members are tubular.

5. The apparatus set forth in claim 1 wherein:

said column members are each connected at their upper ends to means supporting a drive housing for supporting said drive sprocket means for each of said conveyor members, respectively.

6. The apparatus set forth in claim 5 wherein:

said means for supporting said drive housing includes a flange extending along an upper portion of each of said plate members, said drive housing being supported on said flanges, and said drive housing supports said drive sprocket means and separate motor means drivably connected to said drive sprocket means, respectively, whereby reaction pulldown and hoist loads on said tubing are transferred from said drive sprocket means to said drive housing to said flanges and to said plate members and said column members, respectively.

7. The apparatus set forth in claim 5 wherein:

said drive housing is secured to said plate members and supports respective drive motors drivably connected to respective drive shafts for drivably supporting said drive sprockets for each of said conveyor members, and said drive motors include respective hydraulically actuated brakes connected to said drive shafts between said drive motors and said drive sprockets for applyfng braking forces directly to said drive shafts.

8. Apparatus for injecting and withdrawing a substantially continuous length of flexible tubing into and from a well, respectively, said apparatus including:

a frame;

a pair of opposed endless flexible conveyor members supported on said frame and having opposed elongated parallel runs spaced apart to form a path for engagement of said tubing by gripper means on said conveyor members, said conveyor members being trained over spaced apart drive and idler sprocket means associated with respective ones of said conveyor members;

said frame including a base member, a pair of spaced apart upstanding plate members supported on said base member and supporting therebetween said conveyor members and at least one of said sprocket means for each of said conveyor members, and spaced apart generally vertically extending column members supported on said base member, said column members are each connected at their upper ends to means supporting a drive housing for supporting said drive sprocket means for each of said conveyor members, respectively, said column members being disposed along opposite vertical sides of each of said plate members and connected to each of said plate members, respectively, for transmitting at least a portion of reaction pulldown and hoist loads from said plate members to said base member during operation of said apparatus to move said tubing into and out of said well;

a generally rectangular sub-base member disposed under said base member and including means for hinging said base member to said sub-base member along one side of said base member, and load sensing means interposed between said base member and said sub-base member along a side of said base member opposite said one side for measuring reaction loads on said frame from injecting and withdrawing said tubing with respect to said well.

9. The apparatus set forth in claim 8 including:

a frame connected to said sub-base member and comprising spaced apart corner column members extending upward from said sub-base member to a support member disposed above said drive housing, said support member supporting a tubing guide mechanism for guiding said tubing along a portion of a feed path of said tubing between a reel for storing a coiled supply of said tubing and said path extending between said runs.

10. The apparatus set forth in claim 9 wherein:

said guide mechanism comprises an arcuate boom having tubing guide means disposed thereon, said boom being mounted on said support member and connected to said support member by bearing means whereby said boom may be pivoted about an axis substantially aligned with said path extending between said runs to align said guide mechanism with the direction of said tubing along said portion of said feed path extending between said reel and said apparatus during injection and withdrawal of said tubing with respect to said well.

11. The apparatus set forth in claim 10 wherein:

said guide mechanism includes a plurality of spaced apart guide roller assemblies mounted on said boom, each of said roller assemblies including at least a first pair of spaced apart guide rollers for guiding said tubing therebetween in a first plane, one of said guide rollers of said first pair being mounted on a housng member pivotally mounted on said boom for movement between an open position wherein said one guide roller is displaced out of a portion of said path of said tubing extending along said guide mechanism and a closed position wherein said one guide roller is disposed adjacent to the other of said guide rollers for journalling said tubing.

12. The apparatus set forth in claim 11 wherein:

at least one of said roller assemblies is located toward a distal end of said boom with respect to another of said roller assemblies and includes a second pair of guide rollers for guiding said tubing in a plane intersecting said first plane.

13. The apparatus set forth in claim 8 including:

a two part drip pan for collecting lubricant from said conveyor members, said drip pan including opposed separate pan sections removably supported on said sub-base and under said runs of said conveyor members, and means for securing said pan sections to each other for encircling said tubing.

14. Apparatus for injecting and withdrawing a substantially continuous length of tubing into and from a well, respectively, said apparatus including:

a frame;

a pair of opposed endless flexible conveyor members supported on said frame and having opposed elongated parallel runs spaced apart to form a path for engagement of said tubing by gripper means on said conveyor members, said conveyor members being trained over spaced apart drive and idler sprocket means associated with respective ones of said conveyor members;

said frame including a base member, a pair of spaced apart upstanding plate members supported on said base member and supporting therebetween said conveyor members and at least one of said sprocket means for each of said conveyor members, and spaced apart generally vertically extending column members supported on said base member and connected to each of said plate members, respectively, for transmitting at least a portion of reaction pulldown and hoist loads from said plate members to said base member during operation of said apparatus to move said tubing into and out of said well; and means for urging each of said conveyor members toward the other of said conveyor members along at least a portion of said runs to exert a gripping force on said tubing including at least one elongated ramp member engageable with each of said conveyor members along said portions of said runs, respectively, a support bracket for each of said ramp members, a shaft portion extending from opposite sides of each of said brackets perpendicular to the direction of said path of said runs and through clearance slot means in respective ones of said plate members, and opposed hydraulic cylinder and piston actuators connected at their opposite ends, respectively, to the shaft portions extending in the same direction from respective ones of said brackets, said actuators being hydraulically connected to each other in parallel to provide for exerting equal forces on opposite sides of said brackets and on said ramps for urging said ramps toward each other.

15. The apparatus set forth in claim 14 wherein:

at least three of said ramps are arranged in end to end relationship for each of said conveyor members, each of said ramps including a support bracket and oppositely projecting shaft portions extending perpendicular with respect to said path of said runs and through clearance slot means in said plate members, respectively, and a hydraulic cylinder and piston actuator connected at its opposite ends, respectively, to the shaft portions extending in the same direction from each pair of brackets supporting corresponding ramps opposed to each other along said runs, and all of said actuators are interconnected hydraulically in parallel whereby a substantially uniform gripping force is exerted on said conveyor members by said ramps along said runs.

16. Apparatus for injecting and withdrawing a substantially continuous length of flexible tubing into and from a well, respectively, said apparatus including:

a frame;

a pair of opposed endless flexible conveyor members supported on said frame and having opposed elongated parallel runs spaced apart to form a path for engagement of said tubing by gripper means of said conveyor members, said conveyor members being trained over spaced apart drive and idler sprocket means associated with respective ones of said conveyor members;

said frame including a base member, a pair of spaced apart upstanding plate members supported on said base member and supporting therebetween said conveyor members, and spaced apart generally vertically extending column members supported on said base member and connected to each of said plate members, respectively, for transmitting at least a portion of reaction pulldown and hoist loads from said plate members to said base member during operation of said apparatus to move said tubing into and out of said well; and at least one idler sprocket supported on said frame spaced from said drive sprockets and engaged with one of said conveyor members, respectively, said idler sprockets each being supported by bearing means movably supported on said frame for rotatably supporting each of said idler sprockets on opposite sides of said idler sprockets, respectively, and a single pair of opposed hydraulic cylinder and piston actuators mounted on said apparatus on opposite sides of said runs, respectively, said actuators being connected at their opposite ends, respectively, to one of said bearing means for each idler sprocket, said actuators being hydraulically connected in parallel for imposing substantially equal tensioning loads on said conveyor members through said idler sprockets.

17. Apparatus for moving a substantially continuous length of tubing into and out of a well, said tubing being stored on a reel and being adapted to be paid off of and onto said reel in response to operation of said apparatus, said apparatus including:

a frame;

a pair of endless conveyor chains arranged on said frame to form opposed vertical runs when said apparatus is operably disposed at said well, said chains including means for gripping said tubing along a portion of a path disposed between said runs for conveying said tubing in either direction along said path, a drive mechanism mounted on said frame including respective rotatable drive sprockets for each of said chains, at least one idler sprocket supported on said frame spaced from said drive sprockets and engaged with one of said chains, respectively, bearing means movably supported on said frame for rotatably supporting each of said idler sprockets on opposite sides of said idler sprockets, respectively, and a single pair of opposed hydraulic cylinder and piston actuators connected at their opposite ends, respectively, to one of said bearing means for each idler sprocket, said actuators being hydraulically connected in parallel for imposing substantially equal chain tensioning loads on said chains through said idler sprockets.

18. The apparatus set forth in claim 17 wherein:

said idler sprockets are each mounted on shaft means projecting from opposite sides of said idler sprockets, respectively, said shaft means being supported in said bearing means, said bearing means each being supported on said frame and connected to one of said actuators for tensioning said chains.

19. The apparatus set forth in claim 18 wherein:

said bearing means each include a housing, opposed slide means on said housing, and elongated opposed guide means on said frame and associated with each of said housings for supporting said housings for sliding guided movement in response to urging of said actuators.

20. The apparatus set forth in claim 17 wherein:

said idler sprockets are each mounted on shaft means having portions projecting in opposite directions with respect to said idler sprockets, each of said shaft portions being supported in one of said bearing means.

21. Apparatus for moving a substantially continuous length of tubing into and out of a well, said tubing being stored on a reel and being adapted to be paid off of and onto said reel in response to operation of said apparatus, said apparatus including:

a frame;

a pair of endless conveyor chains supported on said frame and arranged to form opposed vertical runs, said chains including means for gripping said tubing along a portion of a path disposed between said runs for conveying said tubing in either direction along said path, said frame including means for supporting a drive mechanism including respective rotatable drive sprockets for each of said chains, at least two elongated opposed ramp means extending along said runs and engageable with respective ones of said chains for urging said chains toward each other to grip said tubing, said ramp means including bracket means including portions extending on opposite sides of said ramp means, respectively, and opposed hydraulic cylinder and piston actuators connected at their opposite ends, respectively, to portions of said brackets extending on the same side of said ramp means, said actuators being hydraulically connected in parallel to provide for exerting equal forces on said ramp means on opposite sides of said bracket means to grip said tubing along said portion of said path, at least one idler sprocket for each of said chains supported on said frame spaced from said drive sprocket and engaged with one of said chains, respectively, bearing means movably supported on said frame for rotatably supporting each of said idler sprockets on opposite sides of said idler sprockets, respectively, and a single pair of opposed hydraulic cylinder actuators connected at their opposite ends, respectively, to one of said bearing means for each idler sprocket, said actuators being hydraulically connected in parallel for imposing equal tensioning loads on said chains through said idler sprockets and on opposite sides of said idler sprockets, respectively.

22. Apparatus for moving a continuous length of flexible tubing between a well and a reel for storing said tubing in a coiled condition, said apparatus comprising:

a frame including means for supporting a pair of elongated endless flexible conveyor members, said conveyor members including elongated parallel runs spaced apart to form a first substantially vertically extending portion of a path of said tubing between said reel and said well along which first portion said tubing is gripped by means on said conveyor members for moving said tubing; and a guide mechanism mounted on said frame for guiding said tubing along a second curved portion of said path for changing the direction of movement of said tubing between said reel and said first portion of said path, said guide mechanism comprising a generally arcuate boom having tubing guide means disposed thereon comprising a plurality of guide roller assemblies mounted spaced apart on said boom, at least one of said roller assemblies including at least a first pair of spaced apart guide rollers for guiding said tubing therebetween in a first substantially vertical plane, one of said guide rollers of said first pair being mounted on a housing member pivotally mounted on said boom for movement between an open position wherein said one guide roller is displaced out of the path of said tubing and a closed position wherein said one guide roller is disposed adjacent to the other of said guide rollers for journalling said tubing.

23. The apparatus set forth in claim 22 wherein:

at least one of said roller assemblies is located toward a distal end of said boom with respect to another of said roller assemblies and includes a second pair of guide rollers spaced apart from each other for guiding said tubing in a plane generally perpendicular to said first plane.

24. The apparatus set forth in claim 23 wherein:

said second pair of guide rollers is mounted on said housing member.

25. The apparatus set forth in claim 22 wherein:
said housing member and said boom include cooperating latch members for latching said housing member in said closed position.

26. The apparatus set forth in claim 22 wherein:
said boom is mounted at one end on said frame and is connected to said frame by bearing means whereby said boom may be pivoted about an axis substantially aligned with said first portion of said path to follow changes in direction of said tubing over a portion of said path extending between said reel and said apparatus.

27. Apparatus for moving a continuous length of flexible tubing between a well and a reel for storing said tubing in a coiled condition, said apparatus comprising:
a frame including a first frame section;
a pair of elongated endless flexible conveyor members supported on said first frame section, said conveyor members including elongated parallel runs spaced apart to form a first substantially vertically extending portion of a path of said tubing between said reel and said well along which first portion said tubing is gripped by means on said conveyor members for moving said tubing;
a second frame section hinged to said first frame section;
a guide mechanism mounted on said second frame section for guiding said tubing along a second curved portion of said path for changing the direction of movement of said tubing between said reel and said first portion of said path, said guide mechanism comprising an arcuate boom having tubing guide means disposed thereon, said boom being mounted at one end on said frame and connected to said frame by bearing means whereby said boom may be pivoted about an axis substantially aligned with said first portion of said path to follow changes in direction of said tubing over a portion of said path extending between said reel and said apparatus; and
load sensing means interposed between said frame sections for sensing reaction loads imposed on said first frame section in response to movement of said tubing by said conveyor members.

28. Apparatus for moving a continuous length of flexible tubing between a well and a reel for storing said tubing in a coiled condition, said apparatus comprising:
a frame including means for supporting a pair of elongated endless conveyor chains, said chains including elongated parallel runs spaced apart to form a first substantially vertically extending portion of a path of said tubing between said reel and said well along which portion said tubing is gripped by means on said chains for moving said tubing; and
a guide mechanism mounted on said frame for guiding said tubing along a second curved portion of said path for changing the direction of movement of said tubing between said reel and said first portion of said path, said guide mechanism comprising an arcuate boom mounted at one end on said frame, and a plurality of spaced apart guide roller assemblies mounted on said boom, each of said roller assemblies including at least a first pair of spaced apart guide rollers for guiding said tubing therebetween in a first plane, one of said guide rollers of said first pair being mounted on a housing member pivotally mounted on said boom for movement between an open position wherein said one guide roller is displaced out of the path of said tubing and a closed position wherein said one guide roller is disposed adjacent to the other of said guide rollers for journalling said tubing.

29. The apparatus set forth in claim 28 wherein:
at least one of said roller assemblies is located toward a distal end of said boom with respect to another of said roller assemblies and includes a second pair of guide rollers for guiding said tubing in a plane perpendicular to said first plane.

30. Apparatus for moving a continuous length of flexible tubing between a well and a reel for storing said tubing in a coiled condition, said apparatus comprising:
a frame including means for supporting a pair of elongated endless flexible conveyor members, said conveyor members including elongated parallel runs spaced apart to form a first substantially vertically extending portion of a path of said tubing between said reel and said well along which first portion said tubing is gripped by means on said conveyor members for moving said tubing;
a guide mechanism mounted on said frame for guiding said tubing along a second curved portion of said path for changing the direction of movement of said tubing between said reel and said first portion of said path, said guide mechanism comprising an arcuate boom having tubing guide means disposed thereon, said boom being mounted at one end on said frame and connected to said frame by bearing means whereby said boom may be pivoted about an axis substantially aligned with said first portion of said path to follow changes in direction of said tubing over a portion of said path extending between said reel and said apparatus; and
said bearing means comprises a bearing plate mounted on a support member of said frame and including arcuate slot means in said bearing plate having a radius center coinciding substantially with the central axis of said first portion of said path, and pin means extending through said slot means for securing said bearing plate to said support member.

* * * * *